US005730457A

United States Patent [19]

Couderc et al.

[11] Patent Number: 5,730,457

[45] Date of Patent: Mar. 24, 1998

[54] APPARATUS FOR MODIFYING THE NATURAL PRESSURE DISTRIBUTION OF A SKI OVER ITS GLIDING SURFACE, AND A SKI EQUIPPED WITH SUCH APPARATUS

[75] Inventors: Bernard Couderc, Annecy; Pierre Szafranski, Pringy, both of France

[73] Assignee: Salomen S.A., Metz-Tessy, France

[21] Appl. No.: 284,461

[22] PCT Filed: Nov. 23, 1992

[86] PCT No.: PCT/FR92/01082

§ 371 Date: Aug. 12, 1994

§ 102(e) Date: Aug. 12, 1994

[87] PCT Pub. No.: WO93/15797

PCT Pub. Date: Aug. 19, 1993

[30] Foreign Application Priority Data

Feb. 18, 1992 [FR] France ..... 92/01959

[51] Int. Cl.[6] ..... A63C 5/07; A63C 7/10

[52] U.S. Cl. ..... 280/602; 280/605; 280/607

[58] Field of Search ..... 280/605, 607, 280/602, 617, 618, 636

[56] References Cited

U.S. PATENT DOCUMENTS

| | | | |
|---|---|---|---|
| 4,061,356 | 12/1977 | Salomon | 280/605 |
| 4,361,343 | 11/1982 | Luitz | 280/605 |
| 4,544,177 | 10/1985 | Svoboda | 280/605 |
| 4,676,520 | 6/1987 | Gasquet et al. | 280/605 |
| 4,729,577 | 3/1988 | Gasquet et al. | 280/605 |
| 4,896,895 | 1/1990 | Bettosini | 280/607 |
| 5,129,668 | 7/1992 | Hecht | 280/618 X |
| 5,135,250 | 8/1992 | Abondance et al. | 280/617 |
| 5,397,149 | 3/1995 | Couderc et al. | 280/602 |
| 5,556,122 | 9/1996 | Arduin et al. | 280/602 |
| 5,558,353 | 9/1996 | Arduin et al. | 280/602 |
| 5,566,966 | 10/1996 | Couderc et al. | 280/602 |

FOREIGN PATENT DOCUMENTS

| | | |
|---|---|---|
| 1270867 | 6/1990 | Canada . |
| 0182776 | 5/1986 | European Pat. Off. . |
| 0183586 | 6/1986 | European Pat. Off. . |
| 0409749 | 1/1991 | European Pat. Off. . |
| 2513132 | 3/1983 | France . |
| 2541124 | 8/1984 | France . |
| 2259375 | 6/1974 | Germany . |
| 4101997 | 9/1991 | Germany . |
| 4039331 | 6/1992 | Germany . |
| WO80/01651 | 8/1980 | WIPO . |
| WO83/03360 | 10/1983 | WIPO . |
| WO93/11838 | 6/1993 | WIPO . |
| WO93/15797 | 8/1993 | WIPO . |

*Primary Examiner*—Brian L. Johnson
*Assistant Examiner*—Michael Mar
*Attorney, Agent, or Firm*—Greenblum & Bernstein P.L.C.

[57] ABSTRACT

A device for modifying the pressure distribution of a ski over its gliding surface. The ski has a base and two binding elements. It further includes a long stiffening member which extends above the base of the ski and which has opposite ends affixed to the ski by base plates. Furthermore, the device includes a calibration device to induce a compression stress in the stiffening member that can vary between two values depending upon the presence or absence of the boot. According to a preferred embodiment, the calibration device includes a toggle joint mechanism constituted by a pair of journalled levers, one of the levers bearing the braking arms for the ski. The invention also is directed to a ski brake.

20 Claims, 9 Drawing Sheets

APPARATUS FOR MODIFYING THE NATURAL PRESSURE DISTRIBUTION OF A SKI OVER ITS GLIDING SURFACE, AND A SKI EQUIPPED WITH SUCH APPARATUS

BACKGROUND OF THE INVENTION

1. Field of the Invention

The invention is related to an apparatus for modifying the natural pressure distribution of a ski, such as especially an alpine ski, over its gliding surface.

The invention is also related to binding elements of a ski, and especially an alpine ski, which are equipped with an apparatus for modifying the pressure distribution of the ski over its gliding surface. The invention is also related to a ski, especially an alpine ski, which is equipped with an apparatus for modifying its pressure distribution over its gliding surface.

2. Description of Background and Relevant Information

Skis that are used for alpine skiing are constituted by relatively long beams on which, most often, the skiers boots are retained by front and rear binding elements. The boots and the binding elements are located approximately in the median zone of the ski, which is commonly known as the middle sole.

The skis themselves have a natural arch at rest. In addition, they have a certain flexibility. While skiing, the ski deforms elastically in response to the various forces to which it is subjected from the skier, and by reaction, from the surface on which it glides.

The main force to which the ski is subjected, originating from the skier, is generated by the skier's weight. This weight is located approximately in the middle sole zone of the ski.

The ski is also biased by the binding elements. It is, in fact, known that the binding elements pinch the boot. To do this, the rear binding element is generally slidably mounted, and is elastically returned forwardly by springs, which are known as return springs. The reaction to this pinching action is transmitted by the binding elements to the ski. However, this reaction is different depending on whether the front binding level of its front end and rear end, cursors by means of which a portion of the forces to which the ski is subject are transmitted vertically. However, this device has the disadvantage of mediocre performance, for a substantial space requirement. It is adapted from the case where both feet of the skier are in support on the same ski, so as to prevent the entire weight of the skier from being concentrated in the middle sole zone. Inversely, it would be mal-adapted in the case of a conventional pair of skis.

From Patent Application No. EP 409 749, an interface device is known comprising a plate which extends above the ski between two abutments affixed to the ski. A shock absorbing block is inserted between each end of the plate and the opposing abutment. According to a special embodiment, a screw, and if necessary, a spring exert a longitudinal pre-stress on the plate.

One can add that currently known devices exert a permanent pre-stress on the ski. Such a permanent pre-stress is detrimental because in the long run it is capable of causing an irreversible deformation of the ski.

One of the objects of the present invention is to propose a device which overcomes these disadvantages, and which enables adjustable pre-stressing of the ski in front of and behind the middle sole zone.

French Patent Application No. FR 2 513 132 describes a brake whose activation pedal comprises two levers journaled with respect to one another at their adjacent end. One of the levers is also journaled to a base affixed to the ski. The other journal bears the braking arms, and is connected to the base at the level of a slot oriented longitudinally. A spring exerts a return force on the movable end of this lever, which tends to fold the two levers against one another.

From European Patent Publication No. 409 749, an interface device is known, including a plate which extends above the ski between two abutments affixed to the ski. A shock absorbing block is inserted between each end of the plate and the opposing abutment. According to a particular embodiment, a screw and, if necessary, a spring exert a longitudinal pre-stress on the plate.

The operation of this device does not exert any significant influence on the ski. Indeed, it has relatively small dimensions, in addition, all the longitudinal forces are transmitted by deformation of the ski.

French Patent Publication No. 2 513 132 describes a brake whose activation pedal includes two levers journalled with respect to each other at their adjacent ends. One of the levers is also journalled to a base affixed to the ski. The other journal bears the braking arms and is connected to the base in the area of a longitudinally oriented slot. A spring exerts a return force on the movable end of the lever, which tends to fold the two levers against each other.

The operation of this device does not exert any significant influence on the ski. In fact, it has relatively small dimensions and all of the longitudinal forces are transmitted by reaction to a single element, viz., the base. Due to this fact, these forces do not affect the structure of the ski.

SUMMARY OF THE INVENTION

One of the objects of the present invention is to propose an apparatus which overcomes these disadvantages, and which enables adjustable pre-stressing of the ski in front of and behind the middle sole zone.

Another object of the present invention is to propose an apparatus which has a reduced space requirement.

Another object of the present invention is to propose an apparatus which only moderately influences the flexibility of the middle sole during flexions of the ski.

Another object of the present invention is to propose an apparatus which generates a flexional pre-stress on the ski only when the ski is in use.

Other objects and advantages of the invention will become apparent upon reading the following description, this description however, being provided as a non-limiting example.

The device according to the invention is intended to modify the pressure distribution of a ski, such as especially an alpine ski, over its gliding surface.

The ski has an elongate base which is equipped with at least one binding element intended to retain a boot in its central middle sole zone, and at least one support element on which the sole of the boot rests. The ski includes a long stiffening member which extends above the base of the ski, the ends of which are affixed to the base of the ski, and means to induce in the stiffening member a compression stress that can vary between two values, a predeterminate non-zero value for gliding and a zero value for non-gliding.

The ski brake is intended to brake the movement of the base of the ski in case the boot that is retained on the ski by at least one binding element is released.

It includes at least one braking arm, movable between a working position wherein the arm projects beneath the lower surface of the base of the ski, and a resting position wherein the arm climbs along the lateral edges of the base of the ski.

It further includes activation means to bring back the arms from their working position to their resting position during engagement of the boot in the binding elements, and an energy means to elastically return the arms into the working position during release of the boot.

According to a particular feature of the invention, the activation means are connected to two distinct zones on the base of the ski and, when activated by the boot, they are subject to a compression stress along a longitudinal direction which is transmitted, by reaction, to the base.

BRIEF DESCRIPTION OF THE DRAWINGS

The invention will be better understood with reference to the description below, as well as the annexed drawings which form an integral portion thereof.

DETAILED DESCRIPTION OF THE PREFERRED EMBODIMENTS

Figure 1:
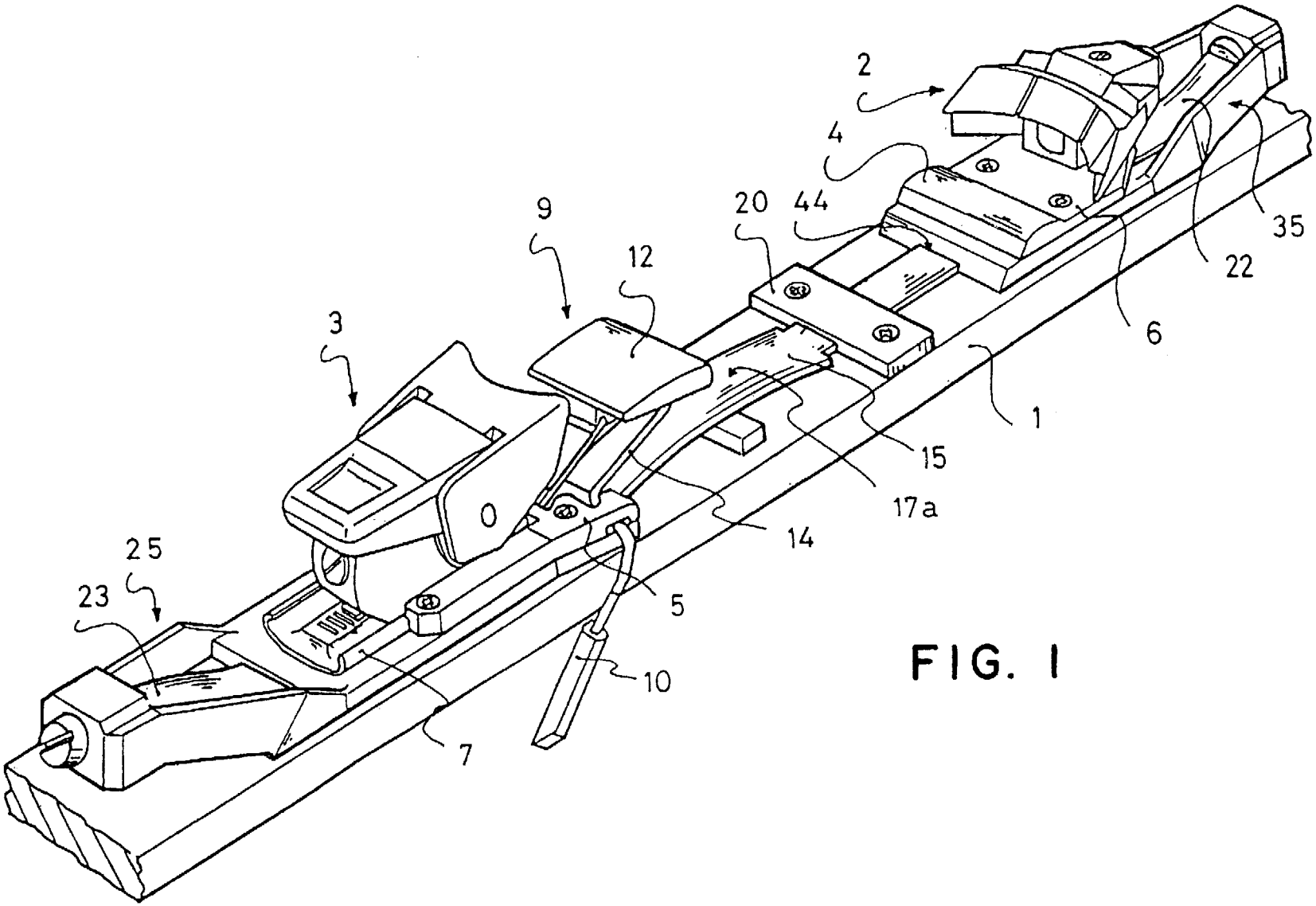
FIG. 1 is a perspective view of the ski in its middle zone, further equipped with an apparatus according to a first embodiment of the invention.

FIG. 1 represents the middle sole zone of a ski. In this zone, the ski has a base 1, on which are mounted two front, and rear binding elements 2 and 3. These binding elements are of any appropriate type, and usually comprise a jaw which retains the front or rear end of the boot, and which is movable against the return force of an elastic return mechanism.

In addition, front binding element 2 has a base 6 by means of which it is affixed to the ski by any appropriate means, and for example, by screwing. Furthermore, a support element 4 is located in the rear portion of base 6, and this support element is intended to receive the front end of the sole of the boot.

In a known manner, rear binding element 3 has a body movable along a slide 7, the slide itself being affixed to base 1 by any appropriate means, for example, by screwing. The front portion of the slide has a support element 5 which is intended to receive the rear end of the sole of the boot.

In addition, a braking device 9 is associated with rear binding element 3. This device is of a known type, and especially comprises at least one, and preferably two, braking arms 10, 11, that are movable between a working position wherein they project beneath the lower surface of base 1 of the ski, and a resting position wherein they rise above the upper surface of the base. An activation device 12, sensitive to the presence or absence of the boot, further controls passage of the braking arms towards the resting position, when the boot is engaged in the binding elements. In the example illustrated, the activation device is a pedal which is connected to braking arm 10 and 11 by connecting rods 14, these connecting rods, in fact, constituting the extension of braking arms 10 and 11 above the upper surface of the base of the ski. A known elastic return device further ensures the return of the braking arms into the working position wherein they project beneath the lower surface of the ski.

This elastic return device elastically opposes the movement of the braking arms from their working position to their resting position.

In addition, the apparatus represented in the figures has a stiffening member or device constituted by a stiffening blade 15 which extends longitudinally above the upper surface of base 1. The central portion of blade 15 extends flat against the upper surface of base 1, approximately between front binding element 2 and rear binding element 3. The ends of the blade are raised with respect to the upper surface of base 1, and are in support along an approximately longitudinal direction against abutments affixed to the base. The blade exerts upon these abutments a thrust oriented towards the ends of the base.

Blade 15 is non-compressible along a longitudinal direction, and further has elastic flexional qualities in the median vertical and longitudinal plane which it defines. It is produced in any appropriate material, and for example, in a possibly fiber-reinforced composite material.

Blade 15, represented in FIGS. 1 to 7, is a single continuous piece having a constant thickness. Blade 15 has two portions, one front portion 16 of a constant width, and one rear portion 17 also of a constant width, but greater then that of portion 16. Both portions 16 and 17 are separated by a shoulder zone 18. An abutment device or limit stop 20, affixed to the ski, further straddles blade 15 in its portion 16. Limit stop 20 has, in its lower portion, a recess 21 whose dimensions correspond to that of a transverse section of portion 16. Limit stop 20 prevents the blade from buckling in its front portion 16. The front and rear ends 22 and 23 of the blade are in support along an approximately longitudinal direction against an abutment affixed to the ski.

Figure 5:
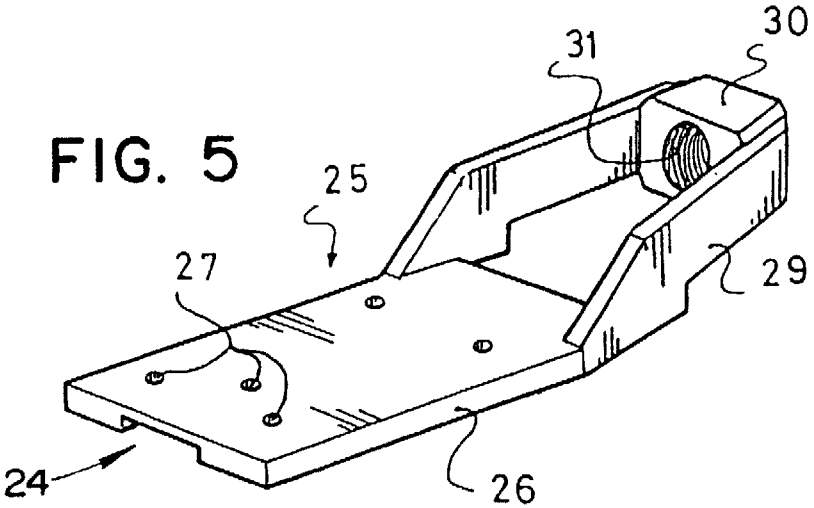
FIG. 5 is a perspective view of a base plate associated with one of the binding elements.
Figure 6:
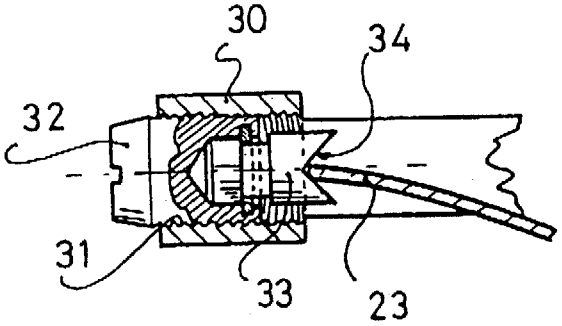
FIG. 6 is a sectional partial side view which illustrates the connection between the end of the stiffening blade and the base plate.
Figure 3:
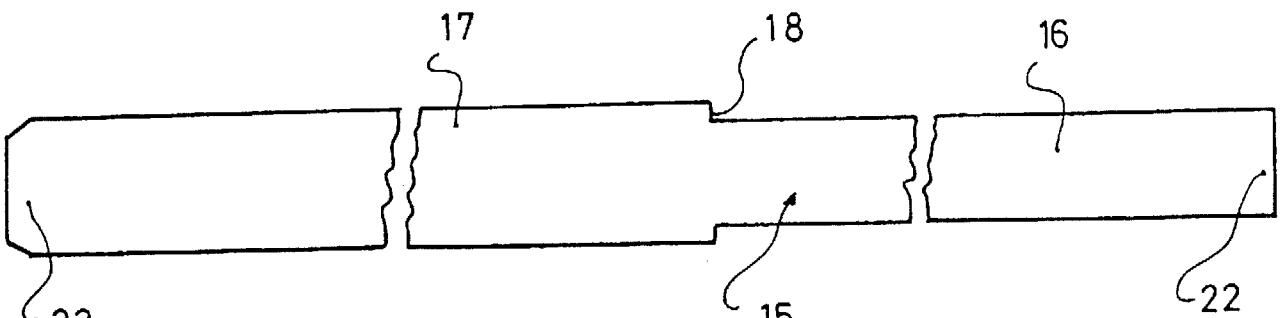
FIG. 3 is a top view of the stiffening blade.
Figure 4:
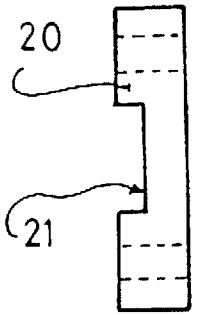
FIG. 4 is a side view of the limit stop which straddles the stiffening blade.

FIG. 5 represents such an abutment for rear binding element 3 in the form of a base plate 25, which has a plate 26 intended to be inserted between slide 7 and the upper surface of base 1. In the lower surface of the pate 26 is an open longitudinal groove 24 for receiving the rear portion 17 of the blade. Behind the plate, a stirrup 29 extends along an inclined direction, such that central portion 30 of the stirrup is raised with respect to the upper surface of base 1. This central portion 30 is longitudinally pierced by a threaded opening 31 in which a threaded plug 32 is screwed at a depth which can be variable. On the side of the blade, plug 32 is equipped with a receiving member or connecting piece 33, which has a notch 34 in which the raised end 23 of the blade is received and takes support along an approximately longitudinal direction.

Furthermore, in its lower portion, plate 26 has a longitudinal groove 24 whose dimensions correspond to those of a transverse section of rear portion 17 of the blade.

According to a not illustrated variation of the embodiment, plate 26 is in two portions, a rear portion which bears stirrup 29, and a front portion, independent of the rear portion, which, in fact, plays the role of thickness wedge.

Figure 2:
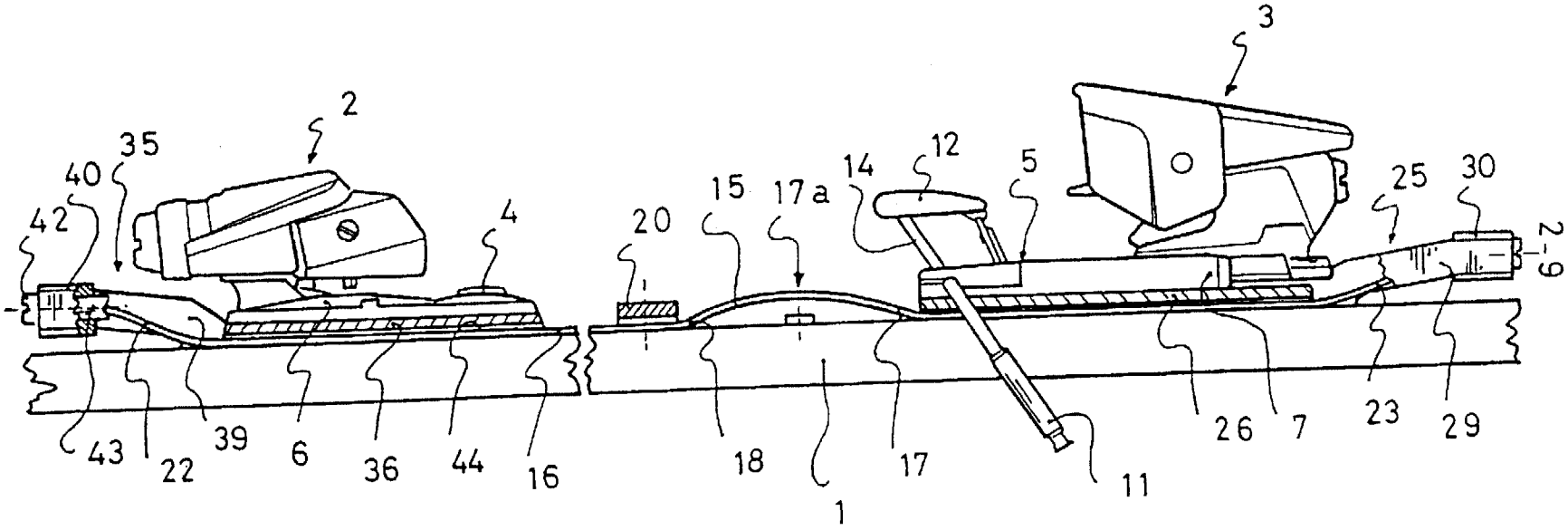
FIG. 2 is a side view of the embodiment represented in FIG. 1.

In the area of front binding element 2, as seen in FIG. 2, e.g. a base plate 35 of the same type is located, with a plate 36 inserted between base 6 of binding element 2 and base 1 of the ski. A stirrup 39, with a central portion 40 equipped with a plug 42, extends forewardly from plate 36. Front end 22 of the blade is in support against a connecting piece 43, movable along a longitudinal direction with the rotation of plug 42.

In addition, bottom plate 36 has a longitudinal groove 44 whose dimensions are substantially the same as those of a transverse section of front portion 16 of the blade. The distance between the two parts 33 and 43 of the front and rear base plates 25, 35 is substantially equal to the length of blade 15. Thus, if plugs 32 and 42 are screwed against the ends of blade 15, a compression stress, opposed by the blade, is generated in the latter. This stress is transmitted by reaction to each of base plates 25, 35, which in turn transmit to the base of the ski a flexional moment, which tends to make the front end and rear end of the base plunge in the direction of the snow. The compression stress to which the blade 15 would be subjected, and therefore the intensity of the flexional moments induced, can be adjusted by means of threaded plugs 32 and 42. The intensity of the flexional moments also depends upon the height of ends 22 and 23 of the blade, with respect to the upper surface of the base.

With reference to FIGS. 1 and 2, it is illustrated that in the front of activation pedal 12, rear portion 17 of blade 15 has a buckling zone 17*a* which extends substantially between limit stop 20 and the front portion of slide 7.

Buckling zone 17*a* and activation pedal 12 of the braking device are provided to cooperate together, i.e., when the activation pedal is driven downwardly by the sole of the boot, it presses on the buckling zone, so as to flatten this zone and stress the blade to expand against each base plate 25, 35.

Figure 7:
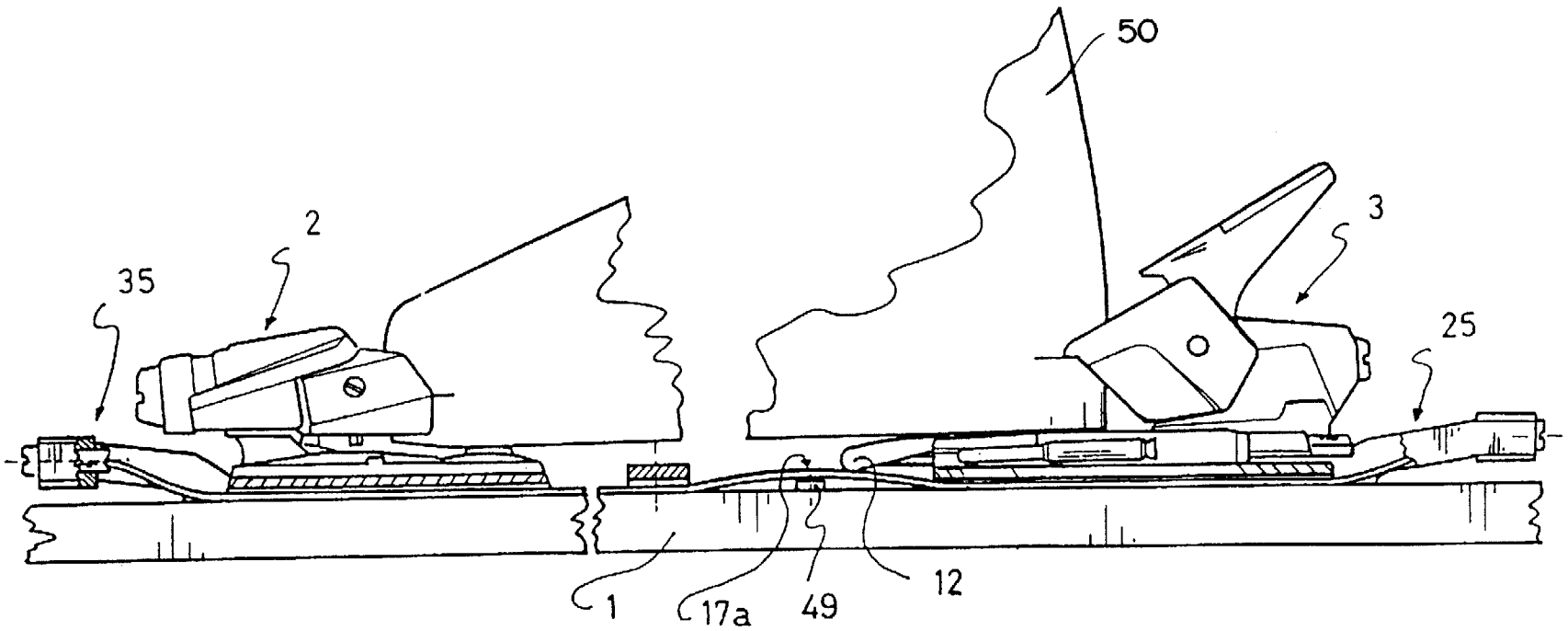
FIG. 7 is a view similar to that of FIG. 2, in another operating position of the device.

With reference to FIG. 7, a boot schematically illustrated with reference numeral 50, is engaged between the front and rear binding elements 2 and 3. Activation pedal 12 of the braking device is located in the low position, between the sole of the boot and buckling zone 17*a* of blade 15, which it presses against the upper surface of base 1. The disappearance of the buckling of zone 17*a*, caused by the presence of boot 50, tends to increase the distance between ends 22 and 23 of the blade, which are in support against front and rear base plates 25 and 35. Therefore, this causes in blade 15 a compression stress which is transmitted to base plates 25 and 35, and which induces a flexional moment of the front end and the rear end of base 1.

When the boot leaves binding elements 2 and 3, or else following an accidental release or a voluntary release, activation pedal 12 rises to the high position corresponding to FIG. 2, under the impulse of the return spring of brake 9, which allows zone 17*a* to be deformed again by buckling. This deformation reduces the action that blade 15 exerts on base plates 25 and 35, which further reduces the flexional moments to which the front and rear ends of the base are subjected.

Possibly, a spacer 49 is placed between the upper surface of base 1 and zone 17*a* of the blade to maintain a buckling initiator when this zone 17*a* is flattened by the pedal against the upper surface of base 1 of the ski.

Thus, a flexional stress is obtained which is generated on the front and rear elements of the ski, and which, depending upon the presence or absence of the boot, varies between a predetermined value and a substantially zero value depending upon the buckling or flattening of zone 17*a* by pedal 12. Zone 17*a* a calibration mechanism for blade 17 which induce a compression stress in the blade.

In addition, the predetermined value of the flexional moments can be adjusted by screwing the threaded plugs 32 and 34, against which ends 22 and 23 of the blade are in support. The more plugs 32 and 42 are screwed, the stronger the stress that blade 15 exerts on the base at the level of plates 26 and 36.

Limit stop 20 can also cooperate with shoulder zone 18 of the blade 15, so that the blade induces a flexional moment having a different intensity towards the front and towards the rear of the ski. Indeed, if limit stop 20 is placed relative to shoulder 18, such that shoulder zone 18 comes in contact with limit stop 20 during flattening of the buckled zone 17*a*, a portion of the compression stress that blade 15 exerts in the direction of the front of the ski is absorbed by limit stop 20, and therefore, does not reach base plate 35. Blade 15 therefore exerts on base plate 35 a lesser thrust force than it exerts on rear base plate 25. The flexional moment induced on the front end of the ski is thus less than the flexional moment induced on the rear.

It can be emphasized that by varying the position of plugs 32 and 42 in base plates 25 and 35, it is possible to make shoulder zone 18 come in abutment against limit stop 20 more or less early in the flattening movement of buckled zone 17*a*. It is therefore possible to independently adjust the intensity of the flexional moments exerted on the front and rear of the ski. Inversely, the buckling of zone 17*a* simultaneously reduces the flexional moments exerted on the front and on the rear.

As a variation, shoulder zone 18 could be located on blade 15 directly behind bottom plate 36, and cooperate with the frontal wall of this bottom plate so that the blade forewardly transmits a thrust force that is weaker towards the front than towards the rear.

One can also reverse the direction of the blade, i.e., have a greater width in the rear portion, and make the shoulder zone cooperate with the frontal wall of rear bottom plate 26. In this case, the flexional moment would be stronger towards the front than towards the rear. Any other abutment means is also suitable.

In the embodiment described hereinabove, it must be noted that only the front and rear ends of the blade are raised with respect to the upper surface of base 1. The central portion of the blade extends against the upper surface of the ski, so that the blade only moderately influences the flexion of base 1 in the middle sole zone.

Also, it must be emphasized that binding elements 2 and 3 are connected to the base of the ski, and not to the stiffening blade. Therefore, very good contact is maintained between base 1 and the sole of the boot, as well as very good transmission of the biases and the forces which are transmitted between the boot and the base of the ski.

Figure 8:
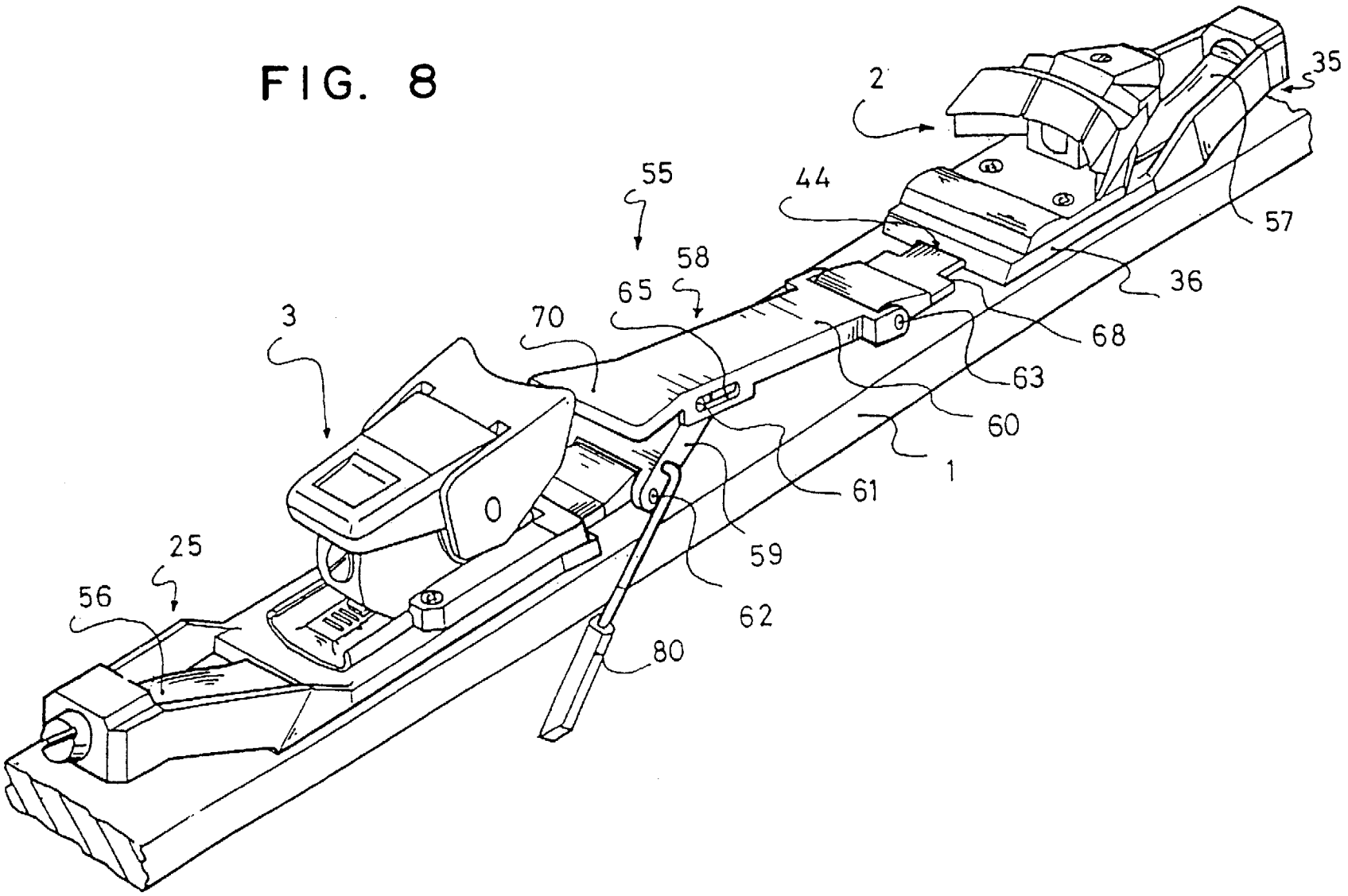
FIG. 8 is a perspective view, in the middle sole zone, of a ski equipped with an apparatus according to another embodiment of the invention.

FIG. 8 illustrates another embodiment of the invention, and more specifically, a variation of the embodiment of the stiffening blade.

FIG. 8 represents a base 1, a front binding element 2 and a rear binding element 3, which are identical to the elements described above. Also, each element is equipped with a base plate 25, 35, which is identical to the previous base plates. A stiffening member or device 55 extends between base plates 25 and 35. Stiffening member 55 comprises a rear portion 56, a front portion 57, and a central toggle joint 58. The rear and front portions 56 and 57 are constituted by portions of the blade which have similar qualities to blade 15 described above, i.e., non-compressible qualities along a longitudinal direction and elastic flexion in a vertical plane. Rear portion 56 extends from base plate 25 to the front of binding element 3, by passing beneath bottom plate 26 associated with this binding element, in the same manner as described previously. Similarly, front portion 57 extends from the front base plate to the rear of binding element 2, by passing beneath this binding element.

A toggle joint device further connects the front end of the rear blade portion to the rear end of the front blade portion. In its embodiment represented in the figure, the calibration mechanism or device 58 comprises two levers 59 and 60, which extend along a longitudinal direction, and which are journaled with respect to one another about a horizontal and transverse axle 61. Rear lever 59 is journaled at the front end of rear portion 56, about a horizontal and transverse axle 62. Similarly, front lever 60 is journaled about a horizontal and transverse axle 63 at the rear end of front portion 57. In the example illustrated, the ends of blade portions 56 and 57, to which levers 59 and 60 are connected, are equipped with a connecting piece 66 and 67, that is respectively crossed by axle 62 and 63.

Axle 61, which connects both levers 59 and 60, is borne by lever 59, and is movable along the longitudinal direction of lever 60 along a slot 65 which is located in the rear portion thereof. Furthermore, in its rear portion, lever 60 has at least one spring which elastically pushes axle 61 towards the rear end of slot 65.

Preferably, lever 60 is extended beyond axle 61 by a platform 70 which comes to cover lever 59 when toggle joint 58 is in its flattened position. In this flattened position, a lower abutment 71 of lever 60 prevents journal axle 61 from passing beneath the alignment of the two other axes 62 and 63, such that the toggle joint never latches and permanently tends to open under the thrust force of spring 69. Preferably also, in the flattened position of the toggle joint, front end 74 of lever 59 comes in support against an abutment surface 75, of lever 60 immediately behind slot 65. In this manner, in the flattened position of toggle joint 58, it is possible to place both levers 59 and 60 in abutment against one another, along a longitudinal direction.

However, one can leave a slight clearance in this area. The stiffening member then exerts an elastic stress on base plates 25 and 36, as long as there is clearance, followed by a non-elastic stress when front end 74 of lever 59 comes in abutment against abutment surface 75. The stiffening member then elastically stresses the base in a first phase of its flexion, and then non-elastically.

The assembly described above functions in the following manner. In the absence of a boot, i.e., in the position represented in FIG. 9, toggle joint 58 is elastically returned in an open position by spring 69. When the boot is engaged in the binding, toggle joint 58 is brought to its flattened position schematically shown in FIG. 10. In this position, spring 69 generates, between the levers of toggle joint 58, and therefore in the entire stiffening member, a compression stress which is transmitted to base plates 25 and 35. When the boot is disengaged from the binding, accidentally or voluntarily, spring 69 returns toggle joint 58 to the open position of FIG. 9, which cancels the previous compression stress.

Toggle joint 58 therefore constitutes calibration means which induce a variable compression stress depending upon the presence or absence of the boot, in connection member 51.

It must be emphasized that base plates 25 and 35 are, as in the prior case, equipped with an adjustment plug 32 and 42. Depending upon the adjustment of these plugs, front end 74 of lever 59 will or will not be in contact with abutment surface 75 of lever 60 in the flattened position of the toggle joint. If there is no contact, the stiffening member will, on the front and rear base plates, generate a thrust force that will tend to increase with the flexions of the ski. Indeed, these flexions of the ski tend to bring the two portions 56 and 57 closer together, resulting in an additional compression of spring 69.

If there is contact, the stiffening member behaves like a non-compressible blade in the same manner as was described for blade 15.

In this case, it would also be possible to make a shoulder zone, similar to zone 18, of either portion 56 or 57 cooperate with the bottom plate of either binding element. FIG. 8 illustrates a shoulder zone 68 which is adapted to cooperate with the frontal surface of bottom plate 36 depending upon the adjustment of plugs 32 and 42.

Figure 9:
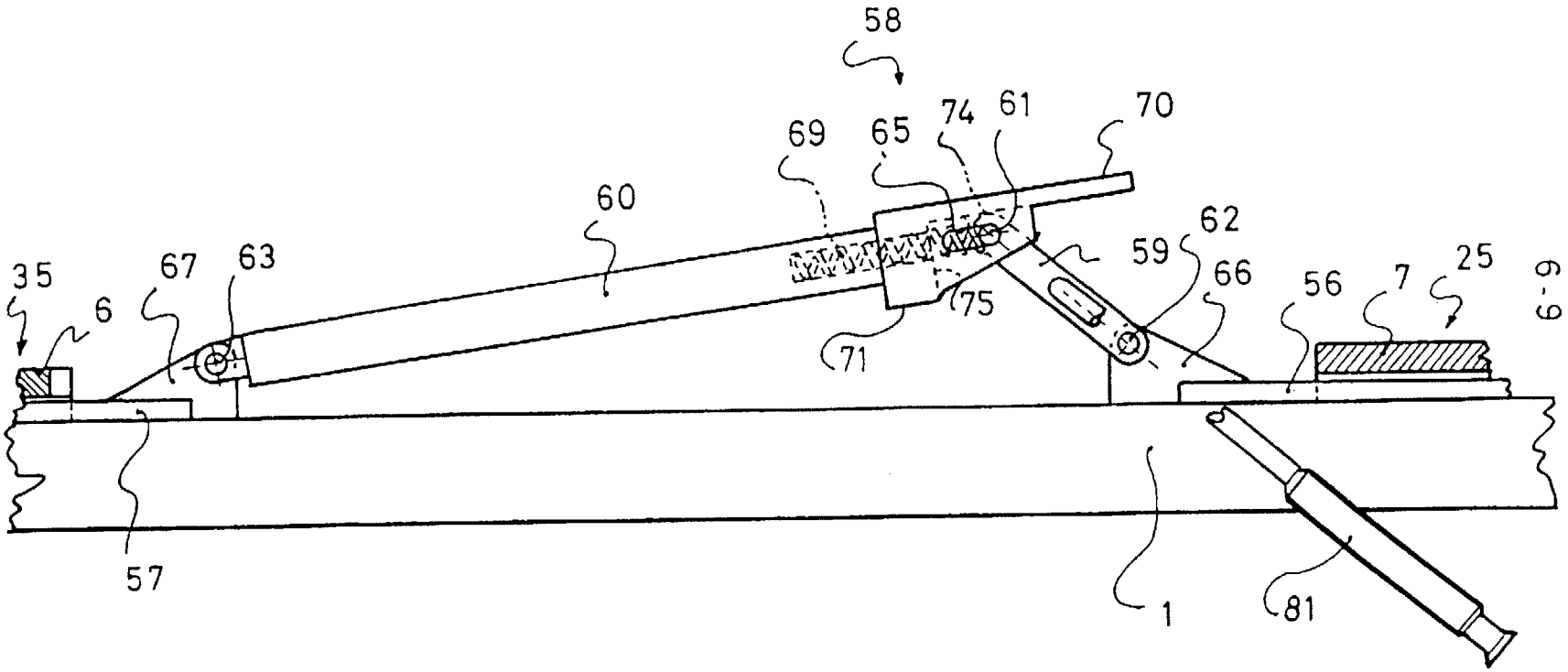
FIG. 9 is a partial side view which illustrates the operation of the present device in FIG. 8, the binding elements are not represented in this Figure.
Figure 10:
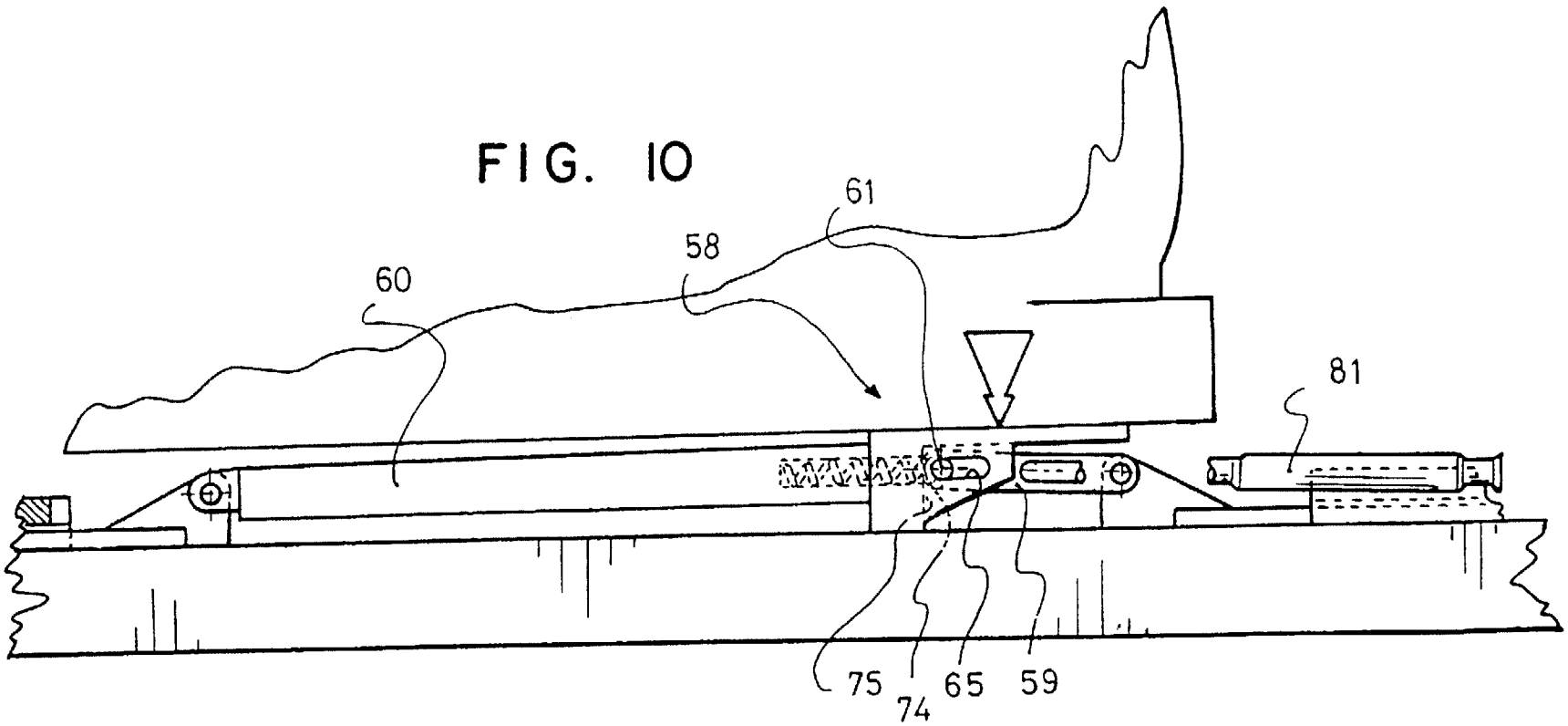
FIG. 10 is a view similar to FIG. 9 in another operating position.

According to a preferred embodiment of this variation, lever 59 bears braking arms 80 and 81. These braking arms follow the rotational movements of lever 59 about axle 62. FIG. 9 represents lever 59 in an inclined position, which causes braking arms 80 and 81 to project beneath the lower surface of base 1. Inversely, in FIG. 10, lever 59 extends substantially along a horizontal direction, and braking arms 80 and 81 are brought above the upper surface of the ski.

Thus, when it is brought to the flattened position, toggle joint 58 exerts two different actions. On the one hand, it generates a compression stress in stiffening member 55, and on the other hand, it brings back the braking arms from their working position to their resting position.

Figure 11:
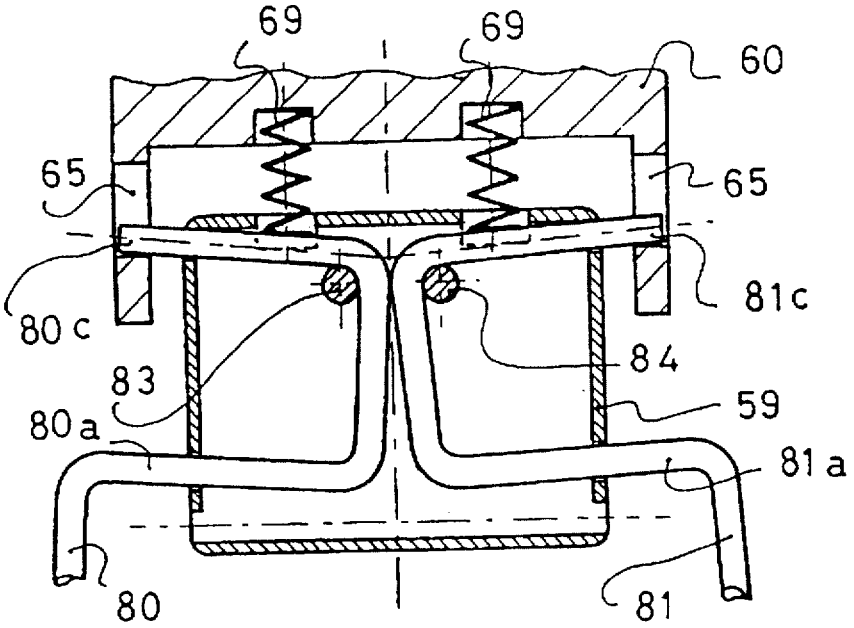
FIGS. 11 and 12 illustrate the retraction mode of the brake which equips the device of FIGS. 9 and 10.
Figure 12:
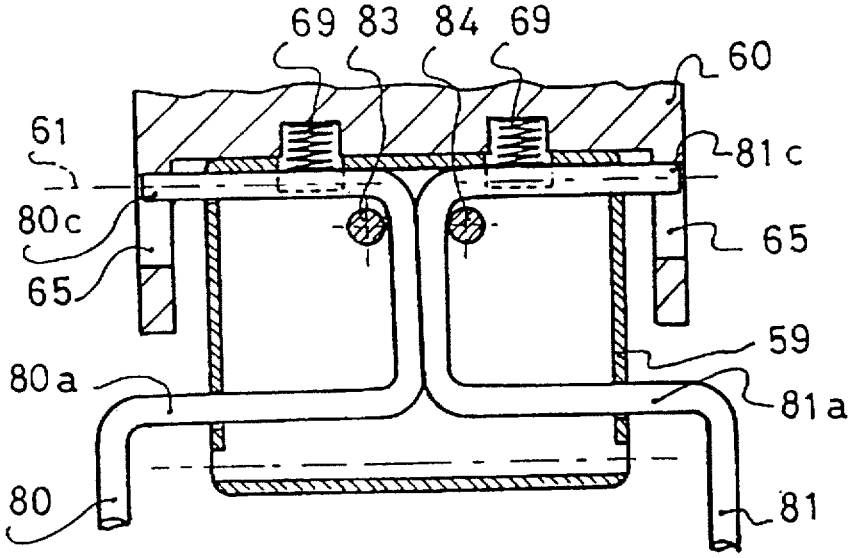

Preferably, in the resting position, means further cause retraction of the brake, i.e., the coming closer of arms 80 and 81 towards the longitudinal median plane of the ski. With reference to FIGS. 11 and 12, lever 59 is constructed in the manner of a hollow housing, the inside of which braking arms 80 and 81 extend by transverse segments **80*a* and 81*a*, then exit by two segments 80*c* and 81*c*, substantially in alignment with one another, which constitute the previously described horizontal and transverse axle 61. This axle runs through slot 65 of lever 60**.

Braking arms 80 and 81 are movable in the plane defined by housing 59, and are maintained in the area of the lateral openings which they cross, as well as by two central plugs 83 and 84. Spring 69, described previously, is split, and each element presses on a segment **80*c* and 81*c* of arms 80 and 81. FIG. 11 corresponds to the open position of the toggle joint, and in this position, springs 69 elastically bias braking arms 80 and 81** upon separation.

FIG. 12 corresponds to the flattened position of the toggle joint. In this position, the ends of segments **80*c* and 81*c* come in abutment in the front portion of slot 65, which forces braking arms 80 and 81** to come closer to the longitudinal plane of the ski.

Figure 13:
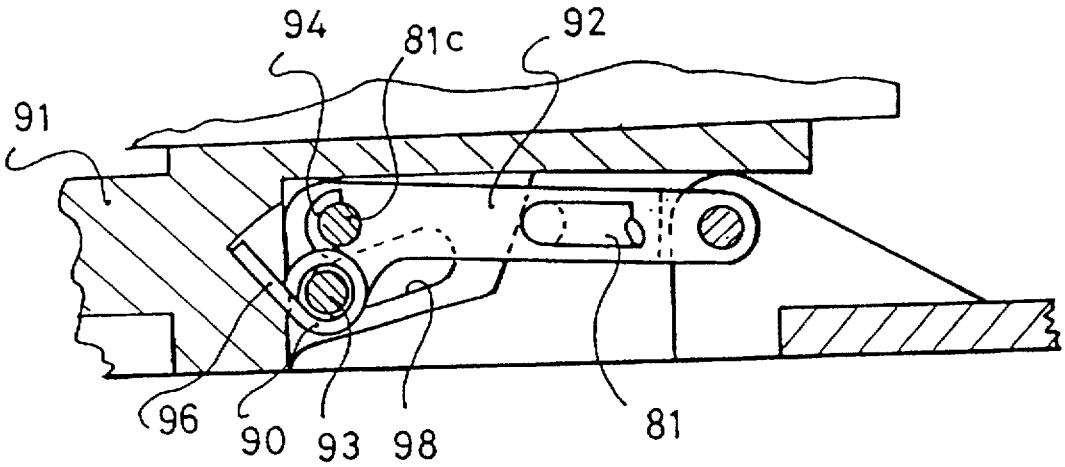
FIG. 13 is a sectional partial side view which illustrates a variation of the embodiment of the apparatus represented in FIGS. 9 and 10.
Figure 14:
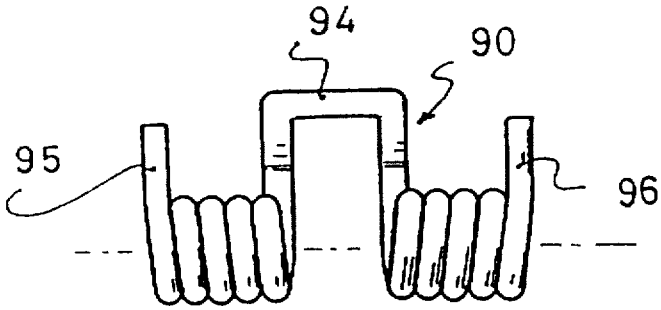
FIG. 14 represents the spring which equips the device of FIG. 13.

FIG. 13 illustrates a variation of the embodiment according to which thrust spring 69 is replaced by a torque spring 90. In this figure, both levers 91 and 92 are mutually journaled about an axle 93. Spring 90 has two coaxial windings at journal axle 93, a central buckle 94 which is in support against segments **80*c* and 81*c* of the braking arms, and two free ends 95 and 96 which themselves are in support against lever 60. As in the prior case, axle 93 is movable along a slot 98 of lever 91**.

This construction operates in the same manner as the construction described previously, aside from the fact that spring 90 biases the toggle joint at the opening, regardless of the position of axle 93 with respect to the two other axes which connect the levers to the rest of the stiffening member.

The operation of this variation is similar to that of the embodiment described previously.

Naturally, the present description is only provided as an example, and other applications of the invention can be adopted without departing from the scope thereof.

In particular, the various embodiments described above could be intended to adapt the constructions to boots of various lengths.

We claim:

1. An apparatus adapted to be mounted upon a ski for modifying a force distribution of the ski over a gliding surface of the ski, the ski adapted to bear at least one binding element for securing a boot to the ski, the apparatus comprising:

a longitudinally extending stiffening device having a front portion and a rear portion, said front portion having a front end and said rear portion having a rear end;

a pair of abutments adapted to be affixed to the ski in a longitudinally spaced apart manner, each of said abutments receiving a respective one of said front end of said front portion of said stiffening device and said rear end of said rear portion of said stiffening device; and said stiffening device further comprising two levers journalled with respect to each other about a generally horizontal and transverse axis at respective portions of said two levers to thereby form a non-stable toggle joint, said two levers generally extending longitudinally between said front end and rear end of said stiffening device, a forward end of a first of said two levers being journalled to said front portion of said stiffening device, and a rearward end of a second of said two levers being journalled to said rear portion of said stiffening device;

said two levers being movable between an active position for inducing a predeterminate positive compression stress in said longitudinally extending stiffening device, when said levers are affixed to the ski, and an inactive position for relieving said compression stress in said stiffening device.

2. An apparatus according to claim 1, further comprising:

an activator, said activator comprising a boot-sensing element for controlling said two levers to move to said active position in response to sensing the boot being secured by the binding elements.

3. An apparatus according to claim 1, wherein:

said toggle joint comprises a boot sensor for moving said two levers to said active position, whereby in the presence of the boot upon said toggle joint, said toggle joint is flattened and said two levers have respective surfaces in longitudinal abutment with each other.

4. An apparatus according to claim 1, wherein:

said two levers of said toggle joint are movable between a flattened position in which the levers are generally longitudinally co-extensive and said axis is in a lowered position, in said active position, and an open position in which the levers are not longitudinally co-extensive and said axis is in a raised position, in said inactive position;

one of said two levers bears a generally horizontal and transverse axle extending along said axis;

the other of said two levers comprises a longitudinally elongated slot within which said axle is positioned for movement within said slot; and at least one spring element positioned for exerting an elastic bias with respect to said axle for biasing said levers of said toggle joint toward said open position.

5. An apparatus according to claim 1, wherein:

one of said two levers bears at least one ski brake arm adapted to engage snow when the device is mounted upon a ski and said ski brake is moved to an activated position.

6. An apparatus according to claim 1, wherein:

one of said two levers comprises a housing for portions of a pair of ski brake arms and for orienting projecting portions of said ski brake arms in predeterminate positions corresponding to respective predeterminate positions of said one lever, whereby pivoting movement of said one lever drives said projecting portions of said ski brake arms between a working position, in which said projecting portions of said ski brake arms project downwardly, and a rest position, in which said projecting portions of said ski brake arms are raised to a substantially horizontal position.

7. An apparatus according to claim 1, further comprising:

an abutment device adapted to be mounted upon the ski, intermediate the ends of the stiffening device, for limiting the magnitude of said predeterminate compression stress exerted by the stiffening device toward one of said front end and said rear end of said stiffening device.

8. An apparatus according to claim 7, wherein:

said abutment device comprises a limit stop straddling said stiffening device, said abutment device including a longitudinally extending recess through which said stiffening device extends and a forwardly facing abutment surface at a front end of said limit stop;

said stiffening device comprises a shoulder for engagement with said forwardly facing abutment surface of said limit stop.

9. An apparatus according to claim 8, further comprising:

a base plate for association with a binding element for the boot;

said limit stop comprises a portion of said base plate.

10. An apparatus according to claim 1, wherein:

each of said abutments which receive a respective one of said front end and said rear end of said stiffening device comprise a receiving member for engaging one of said respective ends of said stiffening device; and each of said receiving members comprises a longitudinal adjustment mechanism for adjusting a longitudinal position thereof with respect to its respective abutment.

11. A ski brake assembly adapted to be mounted upon a ski for braking movement of the ski in response to a boot being released from at least one boot binding, said ski brake assembly comprising:

(a) at least one braking arm;

(b) means for mounting the braking arm for movement between a working position, whereby the braking arm projects beneath a lower ski surface, and a resting position, whereby the braking arm is positioned above the lower ski surface and adjacent a lateral ski surface, said means for mounting comprising:

(i) an activation pedal for engagement with the boot and for movement of the braking arm from the working position to the resting position in response to the boot being engaged by the boot binding, said activation pedal comprising two levers journalled with respect to each other about a generally horizontal and transverse axis at respective portions of said two levers to thereby form a non-stable toggle joint that is movable, in response to the presence or absence of the boot, respectively, between a flattened position against an upper surface of the ski and an open position in which the axis is raised with respect to the upper surface of the ski, one of said two levers bearing the braking arm; and (ii) a mechanism for elastically biasing the braking arm to the working position in response to the boot being released from the boot binding;

(c) a pair of abutments adapted to be affixed to the ski in a longitudinally spaced apart manner; and (d) means for inducing a compression stress against each of said abutments, in response to the boot being in engagement with said activation pedal, and for transmitting said compression stress by reaction to the ski.

12. A ski brake assembly according to claim 11, wherein:

said two levers comprise means for bringing the braking arm closer to a longitudinal median plane of the ski in movement from the working position to the resting position.

13. A ski brake assembly adapted to be mounted upon a ski for braking movement of the ski in response to a boot being released from at least one boot binding, said ski brake assembly comprising:

(a) at least one braking arm;

(b) means for mounting the braking arm for movement between a working position, whereby the braking arm projects beneath a lower ski surface, and a resting position, whereby the braking arm is positioned above the lower ski surface and adjacent a lateral ski surface, said means for mounting comprising:

(i) an activation pedal for engagement with the boot and for movement of the braking arm from the working position to the resting position in response to the boot being engaged by the boot binding, said activation pedal comprising two levers journalled with respect to each other about a generally horizontal and transverse axis at respective portions of said two levers to thereby form a non-stable toggle joint that is movable, in response to the presence or absence of the boot, respectively, between a flattened position against an upper surface of the ski and an open position in which the axis is raised with respect to the upper surface of the ski; and (ii) a mechanism for elastically biasing the braking arm to the working position in response to the boot being released from the boot binding;

(c) a pair of abutments adapted to be affixed to the ski in a longitudinally spaced apart manner; and (d) means for inducing a compression stress against each of said abutments, in response to the boot being in engagement with said activation pedal, and for transmitting said compression stress by reaction to the ski, said means for inducing a compression stress against each of said abutments comprising means for connecting opposite ends of said two levers to said longitudinally spaced apart abutments for inducing said compression stress against said abutments in response to said levers being moved to said flattened position.

14. A ski brake assembly according to claim 13, wherein:

said two levers comprise means for bringing the braking arm closer to a longitudinal median plane of the ski in movement from the working position to the resting position.

15. A ski in combination with an apparatus for modifying a force distribution of the ski over a gliding surface of the ski, the ski adapted to bear at least one binding element for securing a boot to the ski, said combination comprising:

the ski; and the apparatus, the apparatus comprising:

a longitudinally extending stiffening device having a front portion and a rear portion, said front portion having a front end and said rear portion having a rear end;

a pair of abutments adapted to be affixed to the ski in a longitudinally spaced apart manner, each of said abutments receiving a respective one of said front end of said front portion of said stiffening device and said rear end of said rear portion of said stiffening device; and paid stiffening device further comprising two levers journalled with respect to each other about a generally horizontal and transverse axis at respective portions of said two levers to thereby form a non-stable toggle joint, said two levers generally extending longitudinally between said front end and rear end of said stiffening device, an end of a first one of said two levers being journalled to said front portion of said stiffening device, and an end of a second one of said two levers being journalled to said rear portion of said stiffening device;

said two levers being movable between an active position for inducing a predeterminate positive compression stress in said longitudinally extending stiffening device, thereby generating a force against each of said abutments, and an inactive position for relieving said compression stress in said stiffening device.

16. A ski in combination with a ski braking assembly, the ski adapted to bear at least one binding element for securing a boot to the ski, said combination comprising:

the ski; and the braking assembly, the braking assembly comprising:

(a) at least one braking arm;

(b) means for mounting the braking arm for movement between a working position, whereby the braking arm projects beneath a lower ski surface, and a resting position, whereby the braking arm is positioned above the lower ski surface and adjacent a lateral ski surface, said means for mounting comprising:

(i) an activation pedal for engagement with the boot and for movement of the braking arm from the working position to the resting position in response to the boot being engaged by the boot binding, said activation pedal comprising two levers journalled with respect to each other about a generally horizontal and transverse axis at respective portions of said two levers to thereby form a non-stable toggle joint that is movable, in response to the presence or absence of the boot, respectively, between a flattened position against an upper surface of the ski and an open position in which the axis is raised with respect to the upper surface of the ski, wherein one of said two levers bears the braking arm; and (ii) a mechanism for elastically biasing the braking arm to the working position in response to the boot being released from the boot binding;

(c) a pair of abutments adapted to be affixed to the ski in a longitudinally spaced apart manner; and (d) means for inducing a compression stress against each of said abutments, in response to the boot being engaged by the binding element, and for transmitting said compression stress by reaction to the ski.

17. A ski and ski braking assembly according to claim 16, wherein:

said two levers comprise means for bringing the braking arm closer to a longitudinal median plane of the ski in movement from the working position to the resting position.

18. A ski in combination with a ski braking assembly, the ski adapted to bear at least one binding element for securing a boot to the ski, said combination comprising:

the ski; and the braking assembly, the braking assembly comprising:

(a) at least one braking arm;

(b) means for mounting the braking arm for movement between a working position, whereby the braking arm projects beneath a lower ski surface, and a resting position, whereby the braking arm is positioned above the lower ski surface and adjacent a lateral ski surface, said means for mounting comprising:

(i) an activation pedal for engagement with the boot and for movement of the braking arm from the working position to the resting position in response to the boot being engaged by the boot binding, said activation pedal comprising two levers journalled with respect to each other about a generally horizontal and transverse axis at respective portions of said two levers to thereby form a non-stable toggle joint that is movable, in response to the presence or absence of the boot, respectively, between a flattened position against an upper surface of the ski and an open position in which the axis is raised with respect to the upper surface of the ski; and (ii) a mechanism for elastically biasing the braking arm to the working position in response to the boot being released from the boot binding;

(c) a pair of abutments adapted to be affixed to the ski in a longitudinally spaced apart manner; and (d) means for inducing a compression stress against each of said abutments, in response to the boot being engaged by the binding element, and for transmitting said compression stress by reaction to the ski, wherein said means for inducing a compression stress against each of said abutments comprises means for connecting opposite ends of said two levers to said longitudinally spaced apart abutments for inducing said compression stress against said abutments in response to said levers being moved to said flattened position.

19. A ski and ski braking assembly according to claim 18, wherein:

said two levers comprise means for bringing the braking arm closer to a longitudinal median plane of the ski in movement from the working position to the resting position.

20. A ski in combination with a ski braking assembly, the ski adapted to bear at least one binding element for securing a boot to the ski, said combination comprising:

the ski; and the braking assembly, the braking assembly comprising:

(a) at least one braking arm;

(b) means for mounting the braking arm for movement between a working position, whereby the braking arm projects beneath a lower ski surface, and a resting position, whereby the braking arm is positioned above the lower ski surface and adjacent a lateral ski surface, said means for mounting comprising:

(i) an activation pedal for engagement with the boot and for movement of the braking arm from the working position to the resting position in response to the boot being engaged by the boot binding; and (ii) a mechanism for elastically biasing the braking arm to the working position in response to the boot being released from the boot binding;

(c) a pair of abutments adapted to be affixed to the ski in a longitudinally spaced apart manner; and (d) means for inducing a compression stress against each of said abutments, in response to the boot being engaged by the binding element, and for transmitting said compression stress by reaction to the ski, wherein:

said means for inducing a compression stress comprises a stiffening device having longitudinally opposed ends fixed in a longitudinal positional engagement with respective ones of said pair of abutments during use of the ski; and said means for inducing a compression stress comprises means for transmitting a longitudinal force through said stiffening device and against each of said abutments.

* * * * *